United States Patent [19]

Sewter et al.

[11] Patent Number: 4,969,926

[45] Date of Patent: Nov. 13, 1990

[54] WATER WASH METHOD FOR CLEANING RADIOACTIVELY CONTAMINATED GARMENTS

[75] Inventors: Bruce R. Sewter, Browns Mills; Thomas A. Jarvis, Sr.; Matthew A. Kirchner, both of Medford; Anthony J. Prisco, Jr., Cinnaminson, all of N.J.; Arthur M. Bonneau, Bethel Park; Keith E. Trendler, Collingswood, both of Pa.; William E. Briggs, Delran; Larry E. Godfrey, Medford, both of N.J.

[73] Assignee: Westinghouse Electric Corp., Pittsburgh, Pa.

[21] Appl. No.: 412,110

[22] Filed: Sep. 25, 1989

Related U.S. Application Data

[62] Division of Ser. No. 162,454, Mar. 1, 1988, Pat. No. 4,909,050.

[51] Int. Cl.[5] ..... D06F 43/08

[52] U.S. Cl. ..... 8/158

[58] Field of Search ..... 68/18 R, 18 F; 134/109, 134/111; 210/167, 251, 900; 252/626, 631; 8/158

[56] References Cited

U.S. PATENT DOCUMENTS

| | | | |
|---|---|---|---|
| 2,588,774 | 3/1952 | Smith . | |
| 3,276,458 | 10/1966 | Iversen et al. . | |
| 3,284,308 | 11/1966 | Dollfus et al. . | |
| 3,353,378 | 11/1967 | Kahn . | |
| 3,728,074 | 4/1978 | Victor | 68/18 R X |
| 3,870,033 | 3/1975 | Faylor et al. . | |
| 3,976,541 | 8/1976 | Stiteler et al. . | |
| 4,062,697 | 12/1977 | Egli et al. . | |
| 4,143,259 | 4/1984 | Capella et al. . | |
| 4,182,676 | 1/1980 | Casolo | 210/686 X |
| 4,235,600 | 11/1980 | Capella et al. . | |
| 4,578,198 | 3/1985 | Schmidt et al. . | |
| 4,655,909 | 4/1987 | Furuno | 210/900 X |
| 4,770,197 | 9/1988 | Prisco, Jr. et al. | 134/109 |
| 4,781,041 | 11/1988 | Fowler | 68/18 F |
| 4,784,772 | 11/1988 | Gotoh et al. | 210/900 X |

FOREIGN PATENT DOCUMENTS

| | | | |
|---|---|---|---|
| 62-36499 | 2/1987 | Japan | 252/626 |

*Primary Examiner*—Philip R. Coe

[57] ABSTRACT

Both an apparatus and method for water washing garments and removing radioactive contaminates therefrom without the generation of liquid effluents is disclosed herein. The apparatus comprises a washing machine unit having a wash water inlet, a rinse water inlet and an outlet conduit, and a hydraulically closed wash water system. The was water system in turn includes a reservoir of filtered and demineralized water connected to the wash water inlet, a particulate filter unit connected to the outlet conduit for removing particulate impurities from the wash water discharged through the conduit, and a water polisher connected between the particulate filtration unit and the reservoir for supplying the reservoir with filtered and demineralized and chemically purified water. To conserve surfactants and suspension agents added to the wash water in the washing machine unit, the wash water system further includes a diverter conduit connected between the filtration unit and the wash water inlet of the washing machine unit. The apparatus further has a hydraulically closed rinse water system which likewise includes a particulate filtration unit, as well as a water polisher. The apparatus avoids the generation of radioactive liquid effluents by trapping substantially all of the radioactive nucleides in disposable, cartridge-type filter elements that are used in the filtration unit of the wash water system. Moreover, the use of polished water in both the wash and rinse water systems renders the resulting water wash more effective.

9 Claims, 2 Drawing Sheets

WATER WASH METHOD FOR CLEANING RADIOACTIVELY CONTAMINATED GARMENTS

This is a divisional application of Ser. No. 162,454 filed Nov. 1, 1988 and now U.S. Pat. No. 4,909,050.

BACKGROUND OF THE INVENTION

This invention generally relates to garment cleaning apparatuses, and is specifically concerned with a water wash apparatus for both washing the garments worn by maintenance personnel in nuclear power facilities, and radioactively decontaminating them.

Machines for cleaning radioactively contaminated clothing are known in the prior art. Such prior art machines may use either a dry cleaning technique or a water wash technique to achieve the desired end. Of the two techniques, dry-cleaning with the use of fluorocarbon solvents such as freon is presently preferred over known water wash type machines due to the generally superior penetrating ability of fluorocarbon solvents. However, before the relative advantages and disadvantages of these two types of machines can be fully appreciated, some background as to the nature of the clothing cleaned and the environment wherein it is used is necessary.

Present-day nuclear power facilities require various maintenance and operating personnel to work in areas which may be contaminated with radioactive particles. To prevent these radioactive particles from coming into contact with the skin of such personnel, protective clothing in the form of frocks, hoods, and shoe coverings (known as "duck feet" in the art) are worn. After use, it is essential that the clothing be cleaned in such a way that removes substantially all of the radioactive particulates, and all or at least most of the conventional soils, sweats and body salts than can also accumulate therein. The removal of certain rare but highly radioactive particulates, such as the "fuel fleas" which can be generated by the cracking of a fuel rod, is particularly important as such particles are capable of exposing a small, pinpoint area of skin to a dangerous level of radioactivity. However, the cost of performing such a cleaning must be substantially less than the cost of replacing the garment if it is to be cost-effective. If the cost of cleaning approaches the cost of disposing of the old garment and replacing it with another, then garment replacement becomes preferable to garment cleaning.

Dry-cleaning techniques for cleaning such radioactively contaminated clothing are generally preferred over water wash techniques due to the inherently lower surface tension and hence generally superior penetrating ability of the fluorocarbons used in such techniques. While the use of such fluorocarbons has proven effective in removing substantially all of the radioactive particulates from such clothing, such dry-cleaning techniques are not without shortcomings. For example, the fluorocarbons used in such dry-cleaning techniques tend to dissolve the elastomers in certain synthetic rubbers that form parts of boots and other shoe coverings used in maintenance operations. The dissolution of these elastomers causes the synthetic rubbers to become brittle and crack, thereby damaging and ultimately destroying the particular article of clothing containing the synthetic rubber. Other materials used in protective gloves and shoes such as Neoprene® tend to soak up and absorb the fluorocarbons used until unacceptable levels of these fluorocarbons build up in the articles of clothing. While the excess fluorocarbons might be evaporated out of the clothing by the application of additional amounts of heat, such extra or protracted steps in the cleaning process adds to the overall expense of cleaning, and may tend to heat damage the plastic and rubber portions of the clothing, thereby defeating the purpose of the extra dry-out. Still another shortcoming associated with dry-cleaning techniques is the limited ability of fluorocarbons to dissolve sweat and body salts. While the fluorocarbons may succeed in removing substantially all of the radioactive particulates, the accumulation of such sweat and body salts will ultimately give the garment a cumulative "locker room" odor. Moreover, the fluorocarbons used in such dry-cleaning techniques presently cost about $13.00 per gallon, which is not an inconsiderable expense where many gallons are required. Finally, the fluorocarbons used in these techniques are limited (as are most organic solvents) in their ability to dissolve and remove radioactive contaminants in the form of metallic salt, such as cesium 137.

While wet washing techniques avoid many of the shortcomings associated with dry-cleaning techniques in that they are highly effective in dissolving and removing sweat and body salts as well as salts of cesium 137, they, too, have their drawbacks, the most serious being the generation of a water effluent which contains the radioactive particles removed from the clothing. The transportation and disposal of such an effluent significantly contributes to the cost of the wash notwithstanding the fact that the effluent qualifies as a low radiation level waste. While most nuclear facilities have on-site demineralizer systems which are capable of radioactively decontaminating such water, the inconveniences and expenses associated with the use such on-site demineralizer systems also add substantially to the overall cost of such prior art water wash techniques. Still another problem is the relatively lower efficiency of the water used in such systems in penetrating the fabrics that form such clothing and removing radioactive particulates. The relatively lower penetrating ability of water, coupled with the greater effort needed for dry-out due to its lower volatility as compared to freon, generally has the effect of increasing the time necessary to effectively water wash a contaminated garment.

Clearly, what is needed is an apparatus and method for cleaning radioactively contaminated clothing which removes all of the radioactive particulates, and cleans the clothing of sweat, body salts and radionucleide salts without damaging or destroying any of the synthetic rubbers or artificial fibers forming such clothing. Ideally, such an apparatus should be mobile to obviate the need for the transportation of radioactively contaminated garments, which would require the use of special containers and procedures. Finally, such an apparatus should be capable of quickly cleaning a large volume of such clothing at a cost which is substantially lower than the disposal and replacement costs of the garments being cleaned.

SUMMARY OF THE INVENTION

Generally speaking, the invention is both an apparatus and method for water washing garments and removing radioactive contaminates therefrom without the generation of liquid effluents. The apparatus generally comprises a washing machine for washing the garments which includes a wash water inlet, a rinse water inlet, a water outlet, a reservoir of surfactants and suspension agents. The apparatus also comprises a hydraulically closed wash water system that includes a reservoir of polished water connected to the wash water inlet of the washing machine, a particulate filtration unit connected to the outlet of the machine, and a water polishing unit connected between the filtration unit and the wash water inlet for resupplying the reservoir with filtered and polished water. The use of high-purity, polished water in combination with surfactants and suspension agents greatly improves the solvency and penetrating ability of the wash water, thus rendering it comparable in efficiency to known dry-cleaning solvents when the ability of such water to easily dissolve perspiration and salts is considered. Moreover, the generation of liquid effluents is avoided by the use of a hydraulically closed wash water system which recirculates and re-polishes the water while trapping radioactive particulates in filter units that utilize conveniently disposable cartridge-type filter members.

The wash water system may further include a wash water diverter conduit connected at one end between the filtration unit and the polisher, and at the other end directly to the wash water inlet of the washing machine. This conduit includes a valve for selectively diverting water which has been filtered by the filtration unit, but not yet polished by the polisher directly back into the washing machine during the initial washing cycles implemented by the apparatus, thereby avoiding the removal of any surfactants and suspension agents which were initially mixed into the wash water while at the same time protracting the life of the carbon and ion-exchange columns used in the wash water polisher.

The apparatus may further include a closed rinse water system connected between the outlet of the washing machine and the rinse water inlet. This rinse water system includes its own particulate filtration unit and polisher for removing any residual particulates and dissolved impurities in the rinse water discharged from the washing machine water outlet. To maintain the wash and rinse water systems in hydraulic isolation with one another, the apparatus preferably also includes a pair of valves for selectively connecting the washing machine outlet to the wash water system to the exclusion of the rinse water system, and vice versa. The provision of a hydraulically separate rinse water system insures that the last water to immerse the garments is of the purest form and highest quality.

The polisher of both the wash water system and the rinse water system each include a pair of polishing banks connected in parallel for reducing the pressure drop associated with such polishers. Each of the polishing banks preferably has a column of particulate carbon for removing dissolved gases and organic impurities, as well as a mixed cationic-ionic exchange column serially connected downstream from the carbon column. The polisher of the wash water system additionally includes a cationic exchange column and ionic exchange column serially connected between the column of particulate carbon and the mixed cationic-ionic column. In both the rinse and wash water polishers, isolation valves are provided for hydraulically isolating one or the other of the two polishing banks so that repairs may be made on one or the other of the banks without disrupting the operation of the apparatus.

To kill any microorganisms which may be present in the water flowing through the outlet of the washing machine, the outlet may be connected to an outlet conduit which includes an ultraviolet sanitizer. To prevent relatively large particles from clogging the filtration units of both the wash and rinse water systems, the outlet conduit may further include a bag-type filter.

Finally, the washing machine preferably includes a drum capable of spin-drying the garments fast enough to centrifugally remove at least 80% of all of the water absorbed therein. Such high-efficiency spin drying minimizes the number of wash and rinse cycles necessary to effectively clean the garments, and also minimizes the amount of make-up water which must be periodically added to the closed wash and rinse water systems to compensate for water losses.

BRIEF DESCRIPTION OF THE SEVERAL FIGURES

FIGS. 1A and 1B together form a hydraulic schematic diagram of the wash water apparatus of the invention.

DETAILED DESCRIPTION OF THE PREFERRED EMBODIMENT

General Description Of The Apparatus And Method Of The Invention

Figure 1A:
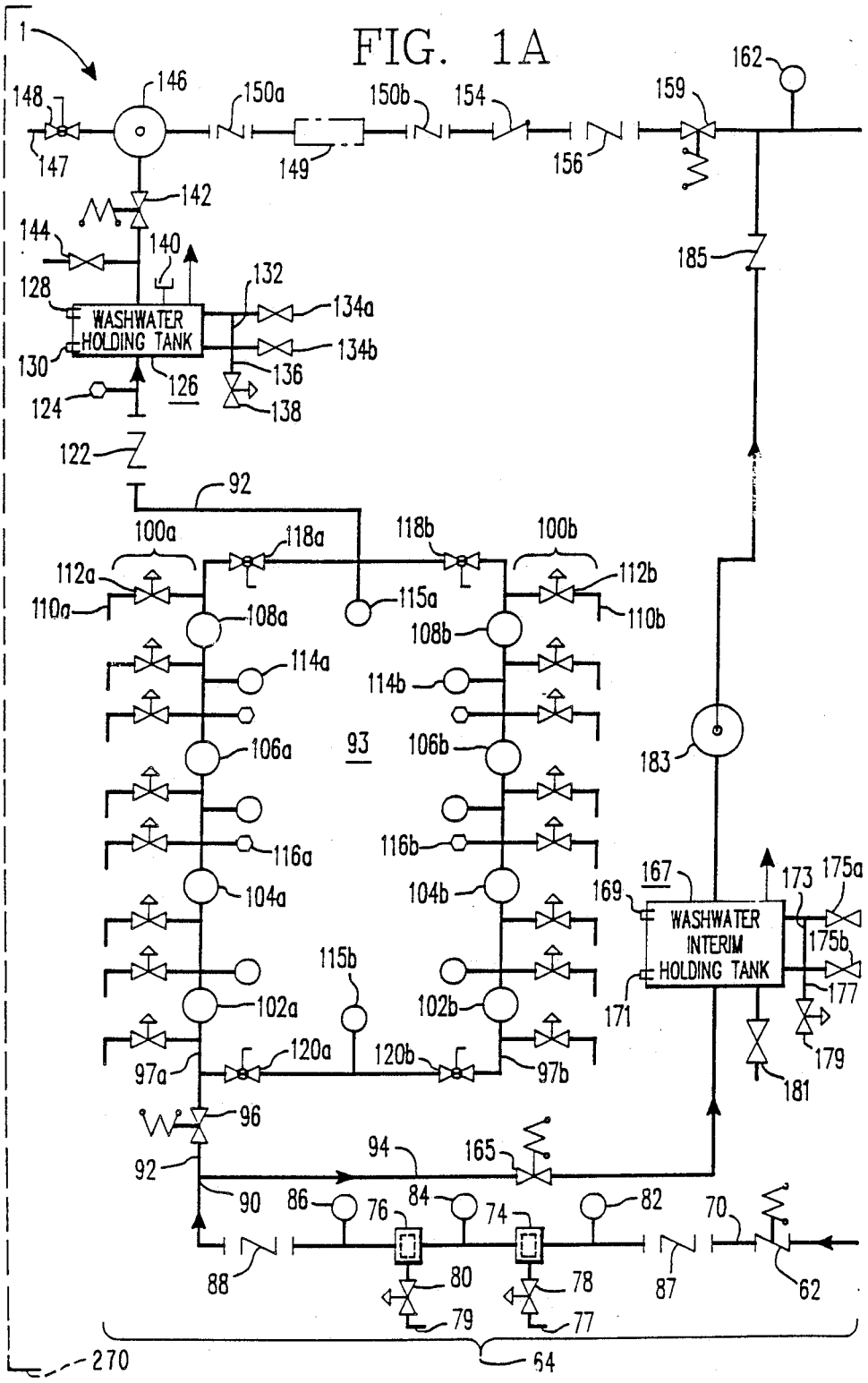
Figure 1B:
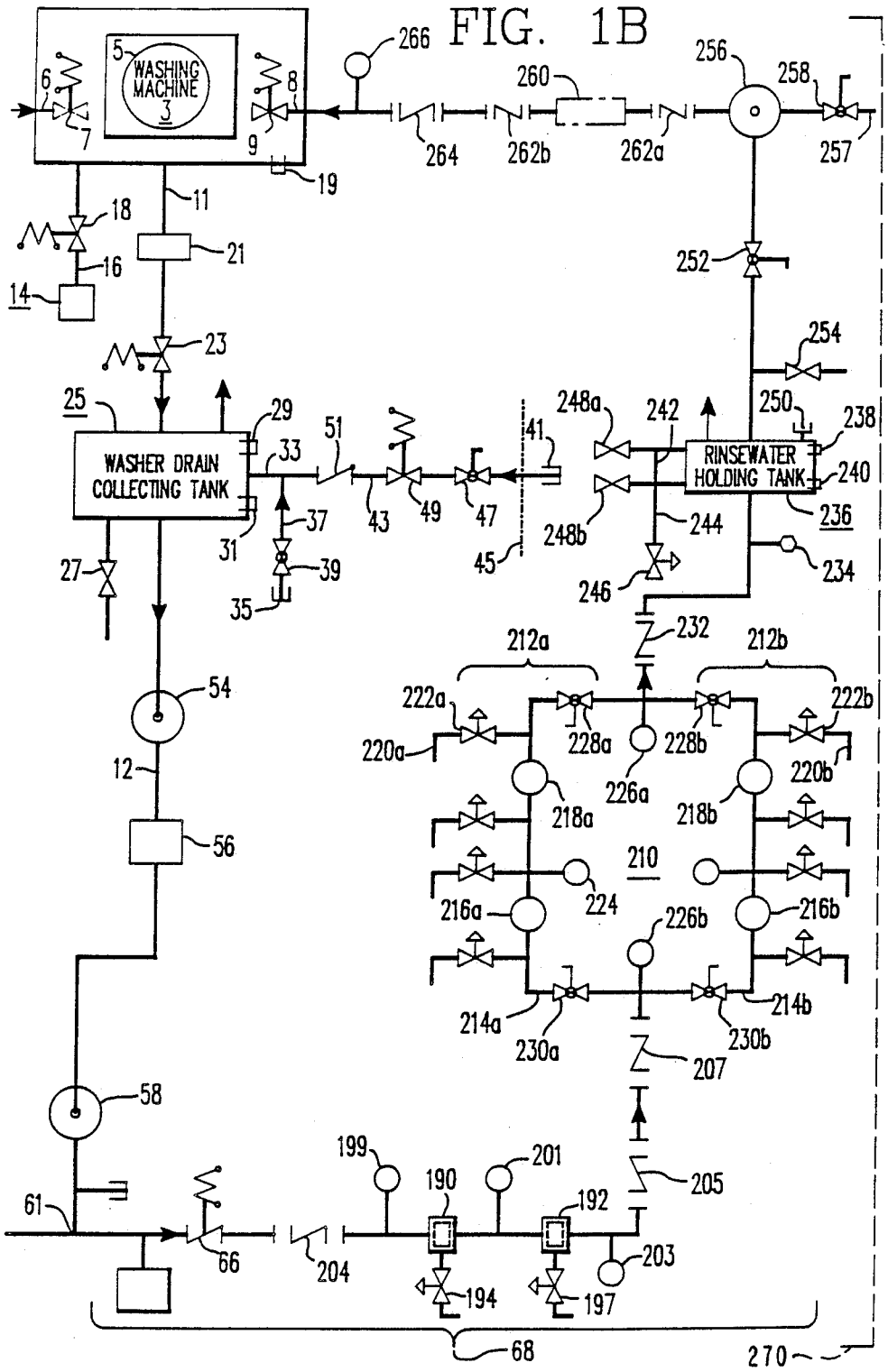

With reference now to FIGS. 1A and 1B, the water wash apparatus 1 of the invention generally comprises a washing machine 3 having a wash water inlet 6, a rinse water inlet 8, an outlet conduit 12, and a surfactant and suspension agent supply reservoir 14. A hydraulically closed wash water system 64 is connected to the wash water inlet 6 at one end and the outlet conduit 12 at the other end. A hydraulically closed rinse water system 68 is connected between the rinse water inlet 8 and the outlet conduit 12. Solenoid operated check valves 62 and 66 connect the outlet conduit 12 of the washing machine 3 either to the wash water system 64 to the exclusion of the rinse water system 68, or vice versa.

The wash water system 64 includes a five-micron particulate filtration unit 74 serially connected upstream to a one-micron particulate filtration unit 76. A water polisher 93 is in turn connected downstream with respect to both filtration units 74 and 76. As will be described in detail hereinafter, most of the radioactive contaminants in the clothing being washed are in the form of particulates of which about 95% are captured by the filtration units 74 and 76. In order to conserve the surfactants and suspension agents which the supply reservoir 14 introduces into the washing machine 3 during the initial washing cycles, the wash water system 64 includes a diverter conduit 94 having a solenoid-operated valve 165. The diverter conduit 94 allows the operator of the apparatus to "short-circuit" water around the water polisher 93 and back into the washing machine 3 which has been filtered by filtration units 74 and 76, but which still contains surfactants and suspension agents by closing valve 96 (leading to the water polisher 93), and opening diverter conduit valve 165. Such operation and use of the diverter conduit 94 advantageously obviates the need for introducing surfactants and suspension agents to the wash water at the beginning of each wash, and further advantageously protracts the life of the various carbon and ion exchange columns of the water polisher 93.

The rinse water system 68 also contains a five-micron particulate filtration unit 190 which is serially connected to a one-micron particulate filtration unit 192. Downstream of these filtration units is a rinse water polisher 210 for insuring the purity of the rinse water circulated through the system 68. The use of polished water in both the wash and rinse water systems 64 and 68 significantly increases the solvency and hence washing effectiveness of the water. Because water from the rinse water system 68 is the last water to touch the garments in the washing machine 3, and because the wash water and rinse water system 64 and 68 are hydraulically isolated from one another, the apparatus insures that the last water to immerse the garments is of the highest quality.

Specific Description Of The Apparatus And Method Of The Invention

With reference again to FIGS. 1A and 1B, the washing machine 3 of the apparatus 1 includes an agitating and spin-dry drum 5 that is preferably capable of handling at least 50 pounds of garments or other fabrics. Additionally, wash and rinse water solenoid-operated intake valves 7 and 9 control the amount of wash or rinse water introduced into the washing machine 3 from either the wash water inlet 6 or the rinse water inlet 8. To control the amount of surfactants and suspension agents introduced into the machine 3, the reservoir 14 has an intake conduit 16 connected to the machine 3 which is provided with a solenoid-operated valve 18. Finally, the machine 3 includes a high-water pressure switch 19 for closing the wash and rinse water intake valves 7 and 9 when the water level of the machine 3 reaches a selected height. In the preferred embodiment, the washing machine 3 is a UNIWASH Model No. FB84/8610No.210 manufactured by D'Hooge, Inc. located in Ledeberg, Belgium. Such a machine is capable of not only thoroughly agitating any garments placed therein in order to effectively clean them, but is also capable of spin-drying the garments quickly enough to squeeze 82% of all the water absorbed therein during either a wash or a rinse cycle. This last feature is important, because it helps to prevent any residual radioactive particles from remaining in the clothing at the end of the wash cycle. It also minimizes the amount of make up water necessary to keep the apparatus 1 in operation.

The outlet conduit 12 includes on its upstream end a bag filter 21 for removing relatively large particles and pieces of debris from the wash or rinse water expelled from the machine 3. The removal of such large particles and chunks of debris not only avoids the fouling of the pumps 54 and 58 (to be described in more detail hereinafter), but further reduces the load on the particulate filtration units 74, 76, and 190, 192 of both the wash and rinse water systems 64 and 68. Located downstream of the bag filter 11 is a solenoid-operated drain valve 23. Unless indicated as being controlled by a pressure switch or some other local controller, all of the solenoid-operated valves in the apparatus 1 are controlled by a programmable central processor unit (not shown) having a timer which implements the method of the invention.

Downstream of the solenoid-operated drain valve 23 is the washer drain collecting tank 25. In the preferred embodiment, tank 25 is formed of stainless steel and has approximately a 30 gallon capacity. The tank 25 of outlet conduit 12 allows either wash water or rinse water to be rapidly drained from the washing machine 3. Such rapid draining facilitates effective cleaning of the garments within the machine 3 by helping to maintain all of the debris and particulate contaminants in suspension as the water is effectively dumped from the machine 3. By contrast, slow drainage would encourage such suspended debris and particulates to deposit themselves on the internal walls of the machine 3, thereby impairing the washing operation. The washer drain collecting tank 25 is provided with a gate-type drain valve 27 that is used when the entire apparatus 1 is drained-down incident to decommissioning, as well as high and low water pressure switches 29 and 31. These switches can actuate and deactuate a self-priming, single impeller pump 54 located downstream of the tank 25. Finally, the tank 25 includes a make-up water inlet 33 that is connected to both an internal make-up water supply 35 by way of a conduit 37 having a ball valve 39, as well as to an external make-up water supply 41 by way of another conduit 43 which extends through the wall 45 of a trailer which contains the apparatus 1. This last conduit 43 of the external make-up water supply 41 includes a serially connected ball valve 47, solenoid valve 49 and ball check valve 51 as indicated. The ball check valve 51 insures that no radioactively contaminated water from the washer drain collecting tank 25 can back up into the external makeup water supply 41.

While it is possible to introduce makeup water at other points in the apparatus 1, the connection of the internal and external makeup water supplies 35 and 41 to the washer drain collecting tank 25 has two advantages. First, because the tank 25 is hydraulically connectable via solenoid-operated valve 62 and 66 to either the wash water system 64 on the rinse water system 68, the hydraulic connection of the makeup water supplies 35 and 41 to the tank 25 allows a single makeup water tap-in to serve the make-up water needs of both the wash and rinse water systems 64 and 68. Secondly, the location of these makeup water supplies 35 and 41 upstream of the water polishers 93 and 210 of the wash and rinse water systems 64 and 68 allows the makeup water used to be undemineralized and unpolished if desired.

Located downstream of the washer drain collecting tank 25 is the previously mentioned self-priming, single impeller pump 54, as well as an ultraviolet sanitizer 56, and a high-pressure pump 58. Preferably, the high-pressure pump 58 is a staged impeller booster pump capable of generating between 55 to 60 pounds per square inch. Such pressure is necessary to push either the wash or the rinse water through the particulate filtration unit 74, 76 and 190, 192 of the wash and rinse water systems 64 and 68 in a reasonably short time. Such pumps are available from Webber Industrial, Inc., located in St. Louis, Mo. 63123, and are sold under the name "Webtrol." While such a staged impeller booster pump is safely capable of generating the pressures necessary for the expeditious circulation of the wash and rinse water in the apparatus 1 without rupturing or jeopardizing the integrity of the CPBC type of piping that is preferably used the conduits in the apparatus 1, it is unfortunately not self-priming. However, this problem is solved by the provision of the single impeller pump 54 located upstream. Pump 54 is capable of creating a pressure of approximately 15 to 20 pounds in the conduit 12, which in turn provides the necessary priming needed for pump 58.

The purpose of the ultraviolet sanitizer unit 56 is to kill any microorganisms which might be present in either the wash or rinse water drained cut of the tank 25. This is important, since such bacteria, fungi, and other microorganisms can lodge in the carbon and ion exchange columns of the polishers 93 and 210 and reproduce, thereby lowering quality of the wash and the the efficacy of the polishers 93 and 210 and accelerating the need for the replacement of columns. In the preferred embodiment, the ultraviolet sanitizer unit 56 (as well as all the other ultraviolet units used in apparatus 1) is either a Model No. UV8G478 or MP2-5L type unit manufactured by Aquafine Corp. for Cullingan. Aquafine Corporation is located in Valencia, Calif. 91355.

Located at the end of the outlet conduit 12 is a T intersection 61 which couples the washing machine outlet 11 to both the wash water system 64 and the rinse water system 68. As has been previously mentioned, solenoid-operated check valves 62 and 66 are provided on either side of the T intersection 61 for admitting water from the outlet conduit 12 to either the wash water system 64 to the exclusion of the rinse water system 68, and vice versa. As such, the solenoid-operated check valve 62 serves as an inlet valve to the wash water system 64, while valve 66 serves the same function with respect to the rinse water system 68.

With respect now to the wash water system 64, the previously mentioned five-micron and one-micron particulate filtration units 74 and 76 are located downstream of the inlet valve 62 as shown. The upstream location of the five-micron filtration unit relative to the one-micron filtration unit has the effect of extending the lifetime of the filtration element used in the one-micron filtration unit 76. In the preferred embodiment, disposal, cartridge-type filter elements (shown in phantom) are used in both of the filtration units 74 and 76 to expedite filter element changes. As has been previously indicated, such filtration units 74 and 76 have proven to be extremely effective in removing radioactive particulate contaminates from the wash water used in the apparatus 1, and together are responsible for approximately 95% of such particulate removal. Water sampling taps 77 and 79 regulated by needle valves 78 and 80 are provided in each of the particulate filtration units 74 and 76 for monitoring purposes. Additionally, pressure gauges 82, 84, and 86 are connected between the inlets and outlets of the particulate filtration units 74 and 76 so that the operator of the apparatus might readily ascertain when the cartridge filter elements used in the units have become saturated and need replacement. Finally, a pair of union ball valves 87 and 88 are disposed upstream and downstream of the particulate filtration units 74 and 76 to facilitate the assembly of the apparatus 1.

Located upstream of union ball valve 88 is T connection 90. One branch of the T connection 90 leads to water polisher conduit 92, which in turn flows into the water polisher 93, while the other branch of the T joint 90 is connected to the previously mentioned wash water diverter conduit 94. Solenoid-operated valves 96 and 165 are disposed at the inlet ends of both the water polisher conduit 92 and the diverter conduit 94, respectively.

Downstream of the solenoid-operated polisher inlet valve 96, the polisher conduit 92 bifurcates into two parallel conduits, **97*a* and 97*b*, each of which is hydraulically connected to separate polishing banks 100*a* and 100*b* of the polisher 93, respectively. Each of the polishing banks 100*a* and 100*b* includes a granulated carbon column 103*a*, 103*b*, a cation exchange 104*a*, 104*b*, an ion exchange column 106*a*, 106*b*, and mixed cation-anion exchange column 108*a*, 108*b*. In each of the banks 100*a*, 100*b* the granulated carbon column 102*a*, 102*b* serves to remove organic contaminates and dissolved gases, while the cation, ion and mixed exchange beds 104*a*, 104*b*, 106*a*, 106*b* and 108*a*, 108*b* each serve to remove dissolved radioactive nucleides from the wash water. Each of these columns preferably contains about three cubic feet of either particulate carbon or an appropriate ion exchange resin. Sampling taps 110*a*, 110*b* having needle valves 112*a*, 112*b* are provided between the various columns so that the water quality at every point within the polisher 93 may be monitored. To help the operator determine whether or not any flow-blocking stoppages have occurred at any point within the polisher 93, pressure gauges 114*a*, 114*b* and differential pressure gauges 115*a*, 115*b* are provided at the points indicated between the carbon and various ion exchange columns, as well as between the polishing banks 100*a*, 100*b* themselves. Finally, ohmic water quality sensors 116*a*, 116*b* are provided in the middle of each bank 100*a*, 100*b* for monitoring purposes. The use of two separate polishing banks 100*a*, 100*b* connected hydraulically in parallel advantageously lowers the back pressure that otherwise would exist across the polisher 93 if only serial connections were used. Moreover, because of the presenCe of isolation valves 119*a*, 119*b* and 120*a*, 120*b* both upstream and downstream in each of the separate polishing banks 100*a*, 100*b*, the polisher 93 is capable of operating during the repair or the replacement of any of the component parts of the banks 100*a*, 100*b*. This redundant capacity is an important advantage, as it avoids the need for a complete shut-down of the apparatus 1** whenever a particular column is repaired or replaced.

Downstream of the water polisher 93 is another union ball valve 122 for assembly purposes, an additional ohmic water quality sensor 124, and finally a wash water holding tank 126. The purpose of the wash water holding tank 126 is to "park" the filtered and polished water produced by the wash water system 64. High and low water switches 128 and 130 are provided in this wash water holding tank 126 for sounding high and low water alarms respectively. In the preferred embodiment, tank 126 has approximately 150 gallons of holding capacity, and serves as a reservoir of polished and filtered water for use in the washing machine 3. The tank 126 includes a water level indicator tube 132 which may be hydraulically isolated from the tank 126 by way of isolation valves **134*a*, 134*b*. For water quality monitoring purposes, the indicator tube 132 is also hydraulically connected to a water testing tap 136 having a needle valve 138. Tank 126 further has a fill port 140 for the addition of filtered and polished makeup water therein, as well as a gate-type drain valve 144 used during a general drain-down of the apparatus 1**.

Located downstream of the wash water holding tank 126 is solenoid-operated valve 132 which controls the admission of wash water from the reservoir provided by the tank 126 into a single impeller, self-priming pump 146. For water testing purposes, pump 146 is hydraulically connected to a water sampling tap 147 by way of ball valve 148. The output of the pump 148 is connected to the water inlet 6 of the washing machine 3 by way of a second ultraviolet sanitizer 149 flanked by union ball valves **150*a*, 150*b*, a ball check valve 154, another union ball valve 156, and a solenoid-operated close-off valve 159. This last valve 159 prevents water that may have been contaminated in the washing machine 3 from backing up from the machine 3 into the purified water present in the wash water holding tank 126. An additional pressure gauge 162 is provided upstream of the water inlet 6 of the washing machine 3** so that the pressure and hence the flow rate of recycled wash water can be monitored.

Turning back to the wash water diverter conduit 94 and a description of the components therein, a wash water interim holding tank 167 is connected to this conduit 94 upstream of the previously mentioned conduit inlet valve 165. In the preferred embodiment, tank 167 is preferably formed from stainless steel and has about a 40 gallon capacity. High and low water switches 169 and 171 are provided therein, as well as a water level indicator tube 173 which may be isolated from the tank 167 by means of isolation valves 175*a*, 175*b*. For quality monitoring purposes, a water sampling tap 177 having a needle valve 179 is connected to the indicator tube 173. The tank 167 also includes a gate-type drain valve 181 to facilitate a general drain-down of the apparatus 1. Downstream of the wash water interim holding tank 167 is another self-priming single impeller centrifugal pump 183. Pump 183 is actuated and deactuated by high and low level water pressure switches 169 and 171. Upstream of pump 183 is a ball-type check valve 185 for preventing the backup of any water from the washing machine 3 back into the tank 167.

The rinse water system 68 includes components which operate in very much the same fashion as the previously described components of the wash water system 64. Specifically, the rinse water system 68 includes a five-micron particulate filtration unit 190 and a one-micron particulate filtration unit 192 serially connected as shown. Each of these filtration units uses disposable, cartridge-type filter elements (shown in phantom). Sample water taps 193 and 196 having needle valves 194 and 197 are provided in each of the particulate filtration units 190 and 192 for water quality testing. Additionally, pressure gauges 199, 201, and 203 are provided upstream and downstream in each of the particulate filtration units 190 and 192 in order to determine the relative extent to which the filter elements in the particulate filtration units 190 and 192 have become saturated. For assembly purposes, all the aforementioned components are flanked by union ball valves 204 and 205.

The rinse water polisher 210 is located downstream of the union ball valve 207, and is comprised of two separate polishing banks 212*a*, 212*b* hydraulically connected in parallel via conduits 214*a*, 214*b*. Each of the banks 212*a*, 212*b* of the rinse water polisher 210 includes a carbon column 216*a*, 216*b* and a mixed cationanion column 218*a*, 218*b*. Water testing taps 220 having needle valves 222 are located between the columns of each of the polisher banks 212*a*, 212*b* for testing purposes. Additionally, pressures gauges 224 and differential pressure gauges 226*a*, 226*b* are installed at various junctions in and between the rinse water polishing banks 212*a*, 212*b* for determining the location of flow-blocking stoppages which may occur in the polisher 210. In order to achieve the same redundant capacity as the wash water polisher 93, isolation valves 228*a*, 228*b* and 230*a*, 230*b* are provided in the locations indicated.

Downstream of the rinse water polisher 210 is a union ball valve 232 for assembly purposes, and an ohmic water quality tester 234. A rinse water holding tank 236 is provided downstream of the rinse water polisher 210 for parking a reservoir of filtered and polished rinse water for use in the washing machine 3. The tank 236 is again preferably formed from stainless steel and has at least a 40 gallon capacity. The tank 236 preferably also includes both high and low water pressure switches 238 and 240 which serve to actuate and deactuate a centrifugal pump 256 located downstream thereof. Finally, the rinse water holding tank 236 includes a water level indicator tube 242 for visually monitoring the level of water therein, a water sampling tap 244 having a needle valve 246, and a pair of isolation valves 248*a*, 248*b* for isolating the water level tube 242 from the tank 236. A fill port 250 and gate-type drain valve 254 are provided as indicated. The outlet of the centrifugal pump 256 located downstream of the tank 236 is connected to a water sampling port 257 by way of a ball valve 258, as well as to the rinse water inlet 8 by way of a ultraviolet sanitizer 260 which is flanked on either side by union ball valves 262*a* and 262*b*. Another union ball valve 264 and a pressure gauge 266 are disposed between the ultraviolet sanitizer 260 and the rinse water inlet 8 as shown.

In the method of the invention, approximately 50 pounds of soiled and radioactively contaminated garments are disposed in the agitating and spin-dry drum 5 of the washing machine 3. The washing machine 3 is actuated and wash water inlet valve 7 is opened. To supply wash water to the washing machine 3, solenoid-operated valves 142 and 159 are opened and centrifugal pump 146 is actuated until the high water pressure switch 19 of the machine 3 indicates that a sufficient amount of wash water has been admitted therein. At this juncture, inlet valve 7 is closed, as are valves 142 and 159. Additionally, centrifugal pump 146 is deactuated.

Next, surfactants and suspension agents are added to the wash water that has been admitted into the washing machine 3 from the surfactant and suspension agent reservoir 14 via conduit 16 and solenoid-operated valve 18. In the preferred method of the invention, approximately a 50/50 mix of type A (for particulates) and type B (for oil and grease) surfactants are used along with a sufficient amount of a commercially available suspension agent to prevent the particulates dislodged from the clothing to become reentrained in the clothing at the end of the washing cycle. The clothes are then thoroughly washed in the machine 3 for approximately 5 minutes.

After the end of the first 5 minute wash, solenoid-operated outlet valve 23 is opened and the wash water is rapidly dumped through a four inch drain first through the bag filter 11 to rid it of all large particulates and pieces of debris, and then into the washer drain collecting tank 25. As soon as high water pressure switch 29 is closed by the rising level of the wash water in the washer drain collecting tank 25, pumps 54 and 58 are actuated. At the same time, solenoid-operated check valve 66 leading into the rinse water system 68 is closed, while wash water system inlet valve 62 is opened so that the wash water proceeds through the five- and one-micron particulate filtration units 74 and 76.

At this juncture, the wash water can either flow through the polisher conduit 92, or through the diverter conduit 94 depending upon whether solenoid-operated valves 96 and 165 are opened and closed, respectively, or vice versa. In the preferred method of the invention, the garments in the washing machine 3 are subjected to three separate washes before being rinsed, although more washes could be added if the garments were heavily soiled. In the first two of the three separate washes, polisher inlet valve 96 is closed while the diverter conduit valve 165 is opened in order to divert the filtered but unpolished wash water into the wash water interim holding tank 167. As soon as the water level in the tank 167 is high enough to actuate the high water switch 169, centrifugal pump 183 is actuated, and wash water inlet valve 7 is opened while close-off valve 159 is closed. As has been mentioned hereinbefore, such hydraulic short-circuiting of the wash water obviates the need for the addition of new surfactants and suspension agents to the wash water with every wash while advantageously extending the lifetimes of the carbon and ion-exchange columns in the wash water polisher 93. Still another advantage associated with such short-circuiting is the expedition of the wash cycle as a whole.

In the last wash of the wash cycle, the conduit diverter valve 165 is closed and the polisher inlet valve 96 is opened so that all dissolved radionucleides, body salts, organic solvents, and dissolved gases are completely removed from the wash water. The resulting purified wash water flows through the union ball valve 122 and into the wash water holding tank 126, where it is "parked" for use in the next wash cycle.

At the end of the last wash of the washing cycle, the drum 5 of the washing machine 3 executes a highspeed extraction by rotating the garments so that they experience centrifugal forces on the order of 400 to 500 Gs. Such large centrifugal forces has the effect of squeezing out approximately 82% of all of water entrained in the garments, even if they are made from highly absorbent material such as cotton. The large degree of water extraction achieved at this juncture by the spin-drying step advantageously removes virtually all of whatever residual particulate contaminates which may have been dislodged by the wash water in the last wash of the cycle. In the preferred method, the spin-drying step lasts approximately four minutes.

In the preferred method of the invention, two separate rinses complete the rinse cycle. Each of the rinses commences with the introduction of rinse water into the rinse water inlet of the machine 3 via inlet valve 9. After the high water level switch 19 of the washing machine 3 has been actuated, the inlet valve 9 is shut off, along with the centrifugal pump 256. The drum 5 then agitates the garments for approximately seven minutes whereupon the rinse water is dumped out through the outlet conduit 12 in virtually the same manner as has been previously described with respect to the wash water system 64. Of course, as the rinse water is being dumped, wash water system inlet valve 62 has been closed and rinse water system inlet valve 66 has been opened, so that the rinse water flows through the five-micron and one-micron particulate filtration units 190 and 192 of the rinse water system 68. From there, the filtered rinse water flows through the rinse water polisher 210 and into the rinse water holding tank 236. When the high level pressure switch of the rinse water holding tank 236 is actuated, centrifugal pump 256 is again actuated, thereby commencing the reintroduction of recycled rinse water into the washing machine 3 and the commencement of the second rinse cycle.

At the end of the second rinse, another spin-drying, high speed extraction step is implemented by the drum 5, which again lasts approximately four minutes. This last spin-drying step not only gives the high-purity water of the rinse water system 68 one last chance to dislodge and remove particulate contaminates from the garments, but also serves to minimize the need for make-up water in the apparatus 1.

What is claimed is:

1. A method of using a washing machine means having a wash water inlet, a rinse water inlet and a water outlet to wash fabrics and to remove radioactive contaminants therefrom without generating liquid effluents comprising the steps of:

(a) placing the fabrics to be washed into the washing machine means;
(b) introducing filtered and polished water into the wash water inlet of the washing machine means to immerse said fabrics;
(c) adding surfactants and suspension agents to the water in the machine means and agitating said fabrics in said water;
(d) discharging the wash water through the water outlet of the machine means;
(e) filtering the discharged water to remove particulate contaminants therefrom;
(f) polishing the filtered wash water, and
(g) recycling the polished, filtered wash water back into the washing machine means.

2. A method as claimed in claim 1, further including the step of recirculating at least one time the wash water that has been filtered but not polished back into the wash water inlet of the washing machine means before finally polishing said water.

3. A method as claimed in claim 1, further including the step of exposing the discharged wash water to a biocide before filtering it in order to kill any microorganisms therein.

4. A method as claimed in claim 1, further including the step of introducing polished rinse water into the rinse water inlet of the machine means after said wash water has been discharged therefrom in order to rinse said fabrics, and then discharging said rinse water through the water outlet of the machine means.

5. A method as claimed in claim 4, further including the step of filtering the discharged rinse water to remove the particulate contaminants therefrom, polishing the filtered rinse water, and recycling the polished, filtered rinse water back into the washing machine means.

6. A method as claimed in claim 4, further including the step of exposing the discharged rinse water to a biocide before filtering it in order to kill any microorganisms therein.

7. A method as claimed in claim 4, wherein said wash water is recirculated through said washing machine means three times, and said rinse water is then recirculated through said machine means twice.

8. A method as claimed in claim 4, wherein said rinse water is recirculated through said washing machine every time wash water is circulated therethrough.

9. A method as claimed in claim 1, further including the step of spin-drying the fabrics in the machine means quickly enough to remove at least 80% of all water absorbed in said fabrics every time said fabrics are immersed in wash or rinse water.

* * * * *